US006347647B2

(12) United States Patent
Christe

(10) Patent No.: US 6,347,647 B2
(45) Date of Patent: Feb. 19, 2002

(54) STATIONARY THREAD GUIDING ELEMENT FOR A SERIES SHED WEAVING MACHINE

(75) Inventor: Marcel Christe, Rüti (CH)

(73) Assignee: Sulzer Textil AG, Rueti (CH)

( * ) Notice: Subject to any disclaimer, the term of this patent is extended or adjusted under 35 U.S.C. 154(b) by 0 days.

(21) Appl. No.: 09/731,531

(22) Filed: Dec. 6, 2000

(30) Foreign Application Priority Data

Dec. 22, 1999 (EP) ..... 99811192

(51) Int. Cl.[7] ..... D03D 41/00; D03D 47/30

(52) U.S. Cl. ..... 139/28

(58) Field of Search ..... 139/28, 435.1, 139/194, 450

(56) References Cited

U.S. PATENT DOCUMENTS

| | | | | |
|---|---|---|---|---|
| 5,146,955 A | * | 9/1992 | Steiner et al. | 139/28 |
| 5,937,913 A | * | 8/1999 | Christe | 139/28 |
| 6,179,011 B1 | * | 1/2001 | De Jager | 139/28 |
| 6,223,778 B1 | * | 5/2001 | Bucher et al. | 139/28 |

FOREIGN PATENT DOCUMENTS

| | | |
|---|---|---|
| EP | 0433216 A1 | 6/1991 |
| EP | 0624672 A1 | 11/1994 |

* cited by examiner

*Primary Examiner*—Andy Falik
(74) *Attorney, Agent, or Firm*—Townsend and Townsend and Crew LLP

(57) ABSTRACT

The stationary thread guiding element (1) for a series shed weaving machine which has a plurality of concentrically extending grooves (1*a*, 1*b*, 1*c*, 1*d*) at an end face (1*i*) is designed as a segment or sector of a circle.

14 Claims, 2 Drawing Sheets

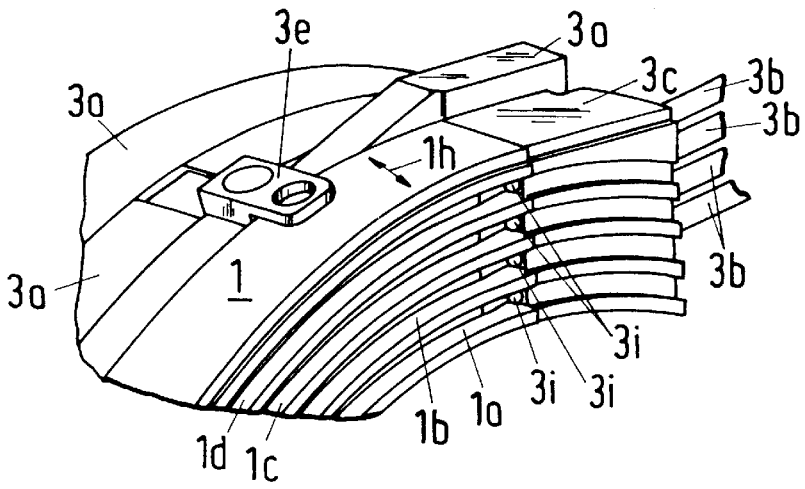
Fig.4
Fig.5
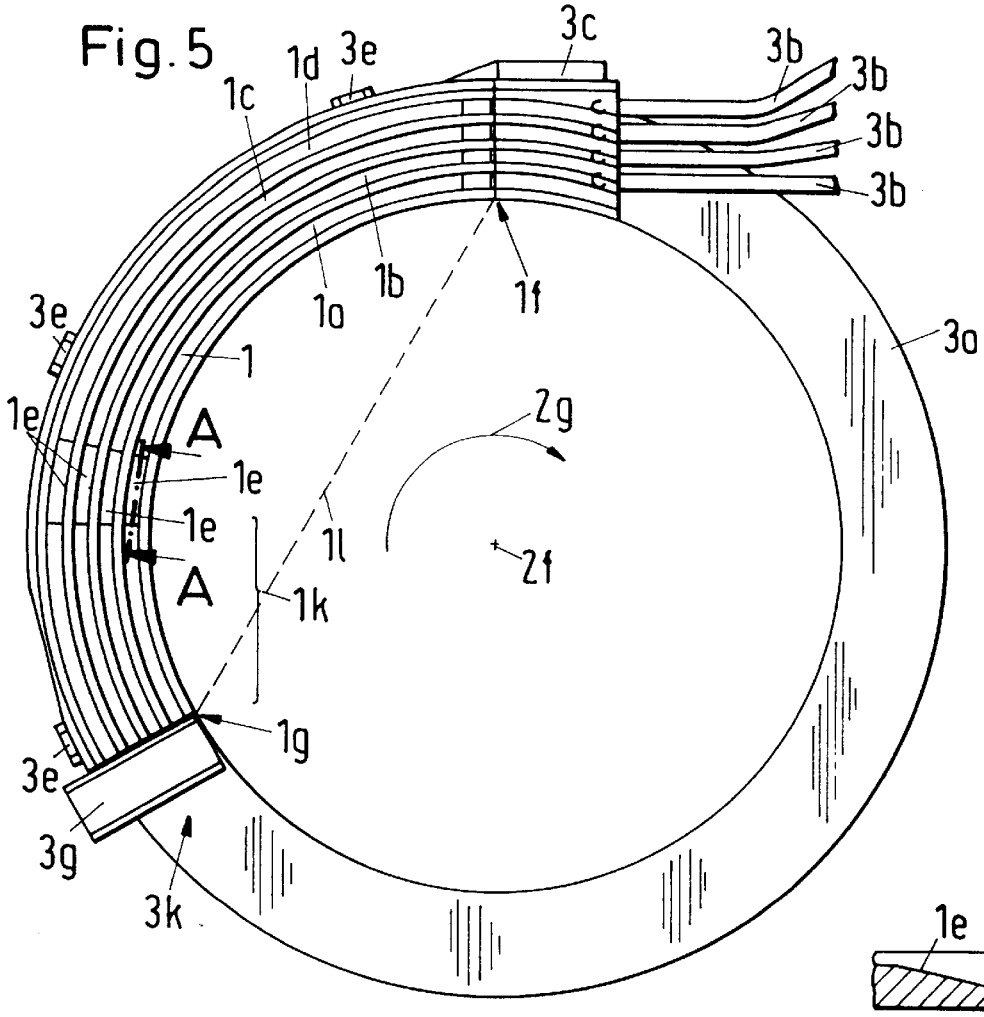
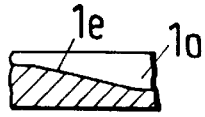
Fig.6
(A-A)

STATIONARY THREAD GUIDING ELEMENT FOR A SERIES SHED WEAVING MACHINE

BACKGROUND OF THE INVENTION

The invention relates to a stationary thread-guiding element to a series shed weaving machine.

A weft thread distributor apparatus of a series shed weaving machine with air jet insertion is known from the patent specification EP 0 433 216 B1. A series shed weaving machine of this kind comprises a rotor which is rotatably journalled about an axis of rotation and at the surface of which a plurality of weft insertion passages are regularly arranged with spacing in the direction extent of the axis of rotation and in the peripheral direction in order to be able to insert a plurality of weft threads, in particular four weft threads, into the weaving rotor at the same time. A weft thread distributing apparatus is arranged at an end face of the weaving rotor and has the task of supplying the weft threads from the stationary supply apparatus to the rotating weaving rotor in such a manner that each weft thread enters into that weft insertion passage through which the weft thread is to be inserted. For this the weft thread distributing apparatus comprises a stationary thread guiding element and a thread guiding element which rotates with the weaving rotor. The known series shed weaving machine uses two circular thread guiding elements, one stationary and one co-rotating thread guiding element, which are formed of metal and which have a plurality of grooves at the end faces through which the weft thread is led. The two end faces either lie one against the other during operation, which leads to a mutual wear; or they are arranged in such a manner that an air gap forms between the two end faces, with it being possible for very thin yarns to enter into this air gap, which leads to a faulty insertion. It is also disadvantageous that contamination accumulates between the end faces during the operation of the series shed weaving machine, which increases the mutual spacing of the two end faces and increases the probability of additional faulty insertions.

SUMMARY OF THE INVENTION

The object of the invention is to propose an economically more advantageous thread guiding element.

The object is satisfied in particular by a stationary thread guiding element for a series shed weaving machine which has a plurality of concentrically extending grooves at an end face, with the thread guiding element being designed as a circular segment or as a circular sector.

An advantage of the stationary thread guiding element in accordance with the invention is that the thread guiding element is shaped as a circular segment or as a circular sector and extends for example over an angular range between 30° and 180°, and preferably over 120°. Through this, on the one hand, the mutual wear of the stationary and the co-rotating thread guiding element is reduced, since their two end faces no longer lie completely against one another, but rather only along the end face which is formed by the stationary thread guiding element. A further advantage is that the accumulation of contamination between the two mutually contacting end faces is reduced, since the end face of the rotor is no longer completely covered over, so that the contamination either falls out by itself or for example is removed with the assistance of additional fluid nozzles which are directed towards the end face.

In an advantageous embodiment the stationary thread guiding element extends over an angular range of 120°. The stationary thread guiding element is thereby very economical to manufacture in that in a first manufacturing step a circular body containing the thread guiding elements is processed and is separated into three equally large parts in a subsequent method step so that three stationary thread guiding elements arise, with each thread guiding element extending substantially over 120°. In a further, advantageous embodiment the stationary thread guiding element consists of a material containing solid lubricants or of a material consisting of a solid lubricant which has a powder-like abrasion during wear, in particular of graphite or PEEK. These materials also have the advantage that the stationary thread guiding element can lie in contact on the end face of the thread guiding element which co-rotates with the weaving rotor, and that no air gap or only a small air gap arises between the end faces of the stationary and the co-rotating thread guiding element. Through this it is also possible to supply very thin yarns and filaments reliably to the weaving rotor without these threads, or fibrils of these threads, being able to enter into a gap between the stationary and the rotating thread guiding elements.

The stationary thread guiding element is preferably designed in such a manner that it is considered to be a part which is subject to wear and that it can be replaced in a very simple and rapid manner. For this, corresponding holding apparatuses are arranged at the stationary part of the series shed weaving machine or at the stationary part of the weft thread distributing apparatus respectively.

BRIEF DESCRIPTION OF THE DRAWINGS

In the following the invention will be explained with reference to a plurality of exemplary embodiments. Shown are:

FIG. 4 is a perspective view of a further exemplary embodiment of a stationary thread guiding element;

FIG. 5 is a front view of the end face of the stationary thread guiding element and of the stationary holding means; and FIG. 6 is a section along the section line A—A of FIG. 5.

DESCRIPTION OF THE PREFERRED EMBODIMENTS

In the following description of the figures similar objects are designated with the same reference symbol.

Figure 1:
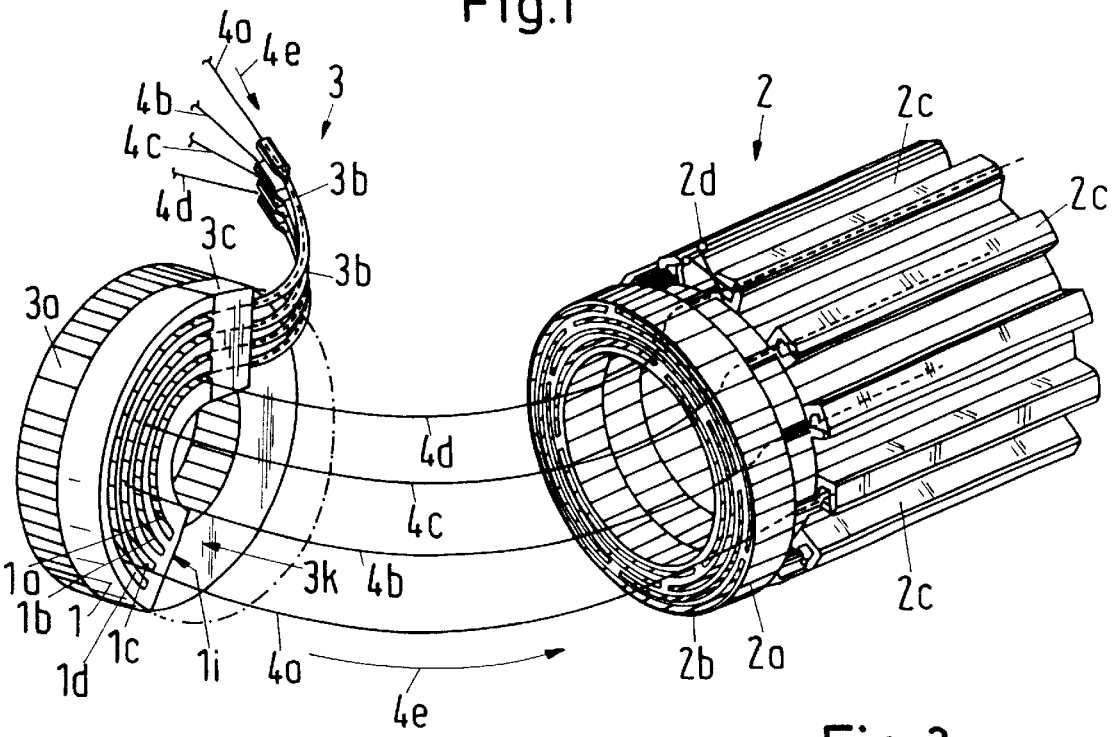
FIG. 1 is a perspective view of a first exemplary embodiment of a series shed weaving machine with a stationary part, a weaving rotor and a stationary thread guiding element.

FIG. 1 shows a weaving rotor 2 of a series shed weaving machine which is journalled about an axis of rotation 2*f* so as to be rotatable in the direction 2*g*. A plurality of weft insertion passages 2*c* are arranged to extend in the direction of the axis of rotation 2*f* and to be spaced in the peripheral direction of the weaving rotor 2. The weft threads 4*a*, 4*b*, 4*c*, 4*d* can be inserted into these weft insertion passages 2*c*. A thread guiding element 2*a* with apertures 2*b* which rotates with the weaving rotor 2 is arranged at the end face of the latter. The delivered weft threads 4*a*, 4*b*, 4*c*, 4*d* are in each case conducted via the corresponding aperture 2*b* of the rotatable thread guiding element 2*a* to the corresponding weft insertion passages 2*c*. As soon as a weft thread 4*a*, 4*b*, 4*c*, 4*d* has been completely inserted it is cut by the thread shear 2*d*, and the end of a weft thread 4*a*, 4*b*, 4*c*, 4*d* which is still located in the rotatable thread guiding element 2*a* is conducted to a further, succeeding aperture 2*b* and then supplied to a new weft insertion passage 2*c*. The stationary part 3 of the supply apparatus of the series shed weaving machine is illustrated laterally swung away with respect to the weaving rotor 2 at the left-hand side in FIG. 1. The stationary part 3 comprises a holding means 3*a* and a stationary transfer part 3*c* into which a plurality of weft thread supply passages 3*b* discharge, through which the weft threads 4*a*, 4*b*, 4*c*, 4*d* are supplied in the weft thread forwarding direction 4*e*. The holding means 3*a* has an end face 3*k* on which the stationary thread guiding element 1 is arranged. The stationary thread guiding element 1 has a plurality of grooves 1*a*, 1*b*, 1*c*, 1*d* which extend in the peripheral direction and are regularly spaced in the radial direction. In the illustrated exemplary embodiment the stationary thread guiding element 1 extends in the peripheral direction of the holding means 3*a* over approximately 120°, with the stationary thread guiding element 1 being arranged to lie in contact at the one end, at a narrow end face, with the stationary transfer part 3*c*.

Figure 2:
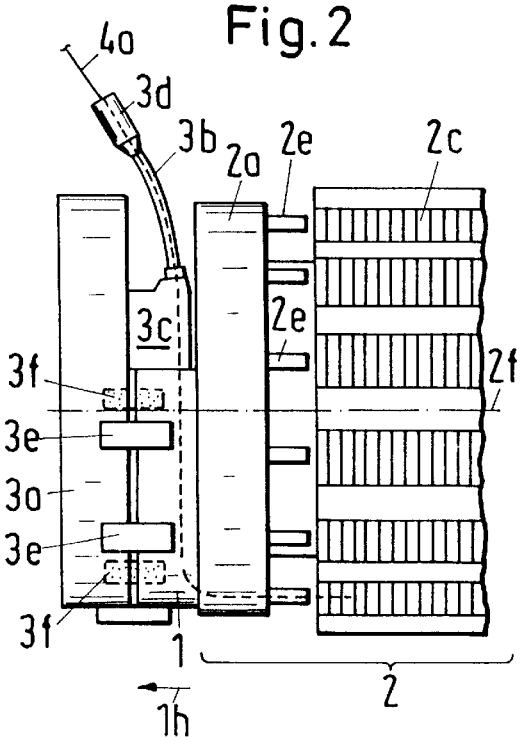
FIG. 2 is an elevation of the arrangement in accordance with FIG. 1 during an operating state.
Figure 3:
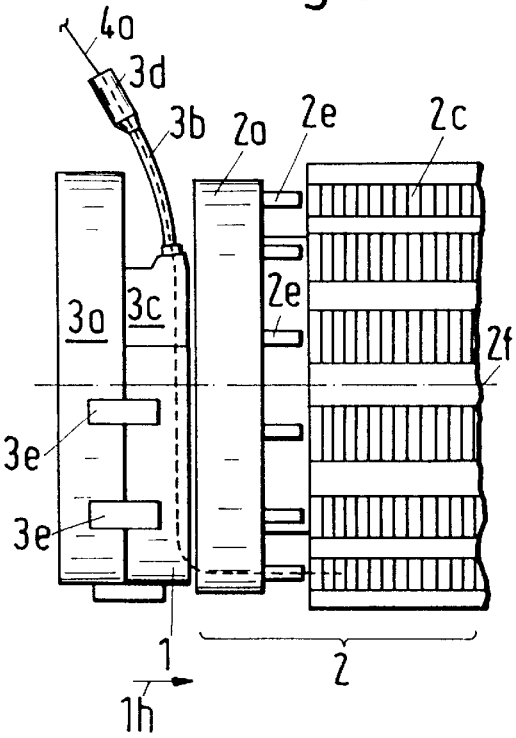
FIG. 3 is the arrangement in accordance with FIG. 1 during a standstill state.

FIG. 2 shows a side view of the series shed weaving machine during operation. A weft thread 4*a* is supplied to the weft thread supply passage 3*b* via the fluid nozzle 3*d*, enters via the stationary transfer part 3*c* into the stationary thread guiding element 1, is deflected therein and is supplied via the rotatable thread guiding element 2*a* and the thread guiding element 2*e* to a weft insertion passage 2*c*. The stationary thread guiding element 1 is mounted so as to be displaceable by the guiding means 3*e* in the direction of extent of the axis of rotation 2*f* and is pressed against the end face of the rotatable thread guiding element 2*a* by the springs 3*f*, which act in the direction of extent of the axis of rotation 2*f*. The stationary thread guiding element 1 is displaceably mounted in the direction of movement 1*h*. In the view in accordance with FIG. 3 the stationary thread guiding element 1 is illustrated to be lying in contact at the holding means 3*a* in a left-hand abutment position. By means of non-illustrated setting means the stationary thread guiding element can be displaced still further to the left together with the holding means 3*a* in order thereby to free and to make accessible the thread guiding passages 1*a*, 1*b*, 1*c*, 1*d*, for example in the event of disturbances such as a break in a weft thread.

The stationary thread guiding element 1 can be moved in the displacement direction 1*h* and led up to the end face of the rotatable thread guiding element 2*a*.

FIG. 4 shows in a perspective view a part of a further exemplary embodiment of a stationary thread guiding element 1 which has four grooves 1*a*, 1*b*, 1*c*, 1*d* which are spaced in the radial direction, and which is mounted so as to be displaceable in the direction 1*h*with respect to the stationary part 3. The stationary part 3 comprises a holding means 3*a* and guiding means 3*e*, which permits a movement of the stationary thread guiding element 1 in the direction 1*h*. The guiding means 3*e* are likewise mounted so as to be displaceable in the movement direction 1*h* and can be displaced to the left in the illustrated arrangement, so that the stationary thread guiding element 1 can be removed and replaced by a new one. The stationary transfer part 3*c* comprises four apertures which form a passage between the weft thread supply passages 3*b* and the exit openings 3*i*. The exit openings 3*i* are arranged with respect to the grooves 1*a*, 1*b*, 1*c*, 1*d* of the stationary thread guiding element 1 in such a manner that in each case an exit opening 3*i* comes to lie in one of the grooves 1*a*, 1*b*, 1*c*, 1*d* when the narrow end face of the stationary thread guiding element 1 contacts the stationary transfer part 3*c*.

FIG. 5 shows a plan view of the holding means 3*a* with a stationary thread guiding element 1 in accordance with the embodiment which is illustrated in FIG. 4. A further holding means 3*g* is arranged at the stationary holding means 3*a* and spaced in the direction of rotation 2*g* of the weaving rotor with respect to the stationary transfer part 3*c* in such a manner that the stationary thread guiding element 1 can be arranged between the stationary transfer part 3*c* and the further holding means 3*g*, with the spacing preferably being chosen in such a manner that the entry-side, narrow end face 1*f* of the stationary thread guiding element 1 lies in contact at the stationary transfer part 3*c*, and in such a manner that the other narrow end face 1*g* of the stationary thread guiding element 1 lies in contact at the holding means 3*g*. In addition the stationary thread guiding element 1 is held by three guiding means 3*e* which are distributedly arranged in the peripheral direction so that the stationary thread guiding element 1 is reliably mounted with respect to the holding means 3*a* and is displaceably mounted in the movement direction 1*h*. The springs 3*f* cause the stationary thread guiding element 1 to be pressed onto the end face of the rotatable thread guiding element 2*a*. The stationary thread guiding element 1, which wears down at the contact surface to the rotating thread guiding element 2*a*, is continually pushed in by the springs 3*f*, so that no gap or only a slight gap arises between the rotatable thread guiding element 2*a* and the stationary thread guiding element 1 at the surfaces of mutual contact.

Starting from the stationary transfer part 3*c* the grooves 1*a*, 1*b*, 1*c*, 1*d* of the stationary thread guiding element 1 extend in the peripheral direction of the stationary holding means 3*a*. In the illustrated exemplary embodiment the grooves have a ramp 1*e*, along which the groove depth is decreased. FIG. 6 shows in a section along the section line A—A the course of a ramp 1*e* of this kind, with the groove depth in the end section 1*k* for example being between 0.1 mm and 1 mm, preferably 0.5 mm.

The stationary thread guiding element 1 is a part which is subject to wear and which must in each case be replaced. The stationary thread guiding element 1 can be designed to be of different length in the peripheral direction and for example have an angular arc length between 30° and 180°, preferably 120°. The stationary thread guiding element 1 is preferably designed to be of a material which contains a solid lubricant or of a material which consists of a solid lubricant, which has the advantage that the powder-like abraded material falls away and/or can be blown or sucked away, so that the end face of the rotatable thread guiding element 2*a* has no or only a slight contamination, even though the stationary thread guiding element 1 is exposed to wear. Graphite or PEEK are suitable in particular as the material. Naturally other plastics are also suitable, in particular those which result in a powder-like abraded material.

The stationary thread guiding element 1 which is illustrated in FIG. 5 is designed in the shape of a circular sector. The thread guiding element 1 could also be designed as a circular segment, as is indicated by the broken line 11. The thread guiding element 1 could however also be designed in the shape of a polygonal train or in another shape.

What is claimed is:

1. A stationary thread guiding element (1) for guiding inserted threads to a series shed weaving machine at a circular side of a rotating rotor (2) having a plurality of weft insertion passages (2*c*), the stationary thread guiding element (1) wherein:

a thread guiding element (1) juxtaposed to the side of the rotating rotor (2) has the shape of a segment of a circle relative to the circular side of the rotating rotor (2), the thread guiding element (1) defining a plurality of concentrically extending grooves (1*a*, 1*b*, 1*c*, 1*d*) at one end face (1*i*) for delivering threads to the weft insertion passages (2*c*) of a rotating rotor (2) at the circular side of the rotating rotor (2).

2. The stationary thread guiding element (1) in accordance with claim 1, wherein:

the stationary thread guiding element (1) extends over an angular range between 30° and 180°.

3. The stationary thread guiding element (1) in accordance with claim 1, wherein:

the stationary thread guiding element (1) consists of a plastic.

4. The stationary thread guiding element (1) in accordance with claim 1, wherein:

the stationary thread guiding element consists of a material containing solid lubricants.

5. The stationary thread guiding element (1) in accordance with claim 4, wherein:

the stationary thread guiding element (1) consists of a material which abuts the rotating rotor and results in a powder-like abraded material when in contact with the side of the rotating rotor (2).

6. The stationary thread guiding element (1) in accordance with claim 1, wherein:

the grooves (1*a*, 1*b*, 1*c*, 1*d*) have a depth which tapers at least section-wise in their direction of extent.

7. The stationary thread guiding element (1) in accordance with claim 1, wherein:

the grooves (1*a*, 1*b*, 1*c*, 1*d*) run out into an end section (1*k*), within which the grooves (1*a*, 1*b*, 1*c*, 1*d*) have a depth between 0.1 mm and 1 mm.

8. The stationary thread guiding element (1) in accordance with claim 1, wherein:

the grooves (1*a*, 1*b*, 1*c*, 1*d*) run out into an end section (1*k*), within which the grooves (1*a*, 1*b*, 1*c*, 1*d*) have a depth of about 0.5 mm.

9. The stationary thread guiding element (1) in accordance with claim 1, wherein:

a stationary holding apparatus (3) has an end face (3*k*) at which a transfer part (3*c*) and also a holding means (3*g*) are arranged, with the transfer part (3*c*) and the holding means (3*g*) projecting with respect to the end face (3*k*) and being spaced in such a manner that the stationary thread guiding element (1) can be removably inserted between the transfer part (3*c*) and the holding means (3*g*).

10. The stationary thread guiding element (1) in accordance with claim 9, wherein:

the transfer part (3*c*) has apertures with exit openings (3*i*); and in that the exit openings (3*i*) are arranged in such a manner that each exit opening (3*i*) opens into one groove (1*a*, 1*b*, 1*c*, 1*d*) of the thread guiding element (1).

11. The stationary thread guiding element (1) in accordance with claim 9, wherein:

the stationary holding apparatus (3) has guiding means (3*e*) at which the thread guiding element (1) is displaceably mounted.

12. The stationary thread guiding element (1) in accordance with claim 11, wherein:

the series shed weaving machine has an axis of rotation (2*f*); and in that the stationary holding apparatus (3) has a spring means (3*f*) which is adapted to act on the thread guiding element (1) in the direction of the axis of rotation (2*f*).

13. The stationary thread guiding element (1) in accordance with claim 1, wherein:

the stationary thread guiding element (1) extends over an angular range of 120°.

14. The stationary thread guiding element (1) in accordance with claim 1, wherein:

the stationary thread guiding element consists of a material containing solid lubricants chosen from the group consisting of graphite and PEEK.

* * * * *